US008203108B2

(12) United States Patent
Geswender et al.

(10) Patent No.: US 8,203,108 B2
(45) Date of Patent: Jun. 19, 2012

(54) FUZE GUIDANCE SYSTEM WITH MULTIPLE CALIBER CAPABILITY

(75) Inventors: Chris E. Geswender, Green Valley, AZ (US); Matthew A. Zamora, Tucson, AZ (US); Cesar Sanchez, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 985 days.

(21) Appl. No.: 12/188,568

(22) Filed: Aug. 8, 2008

(65) Prior Publication Data

US 2010/0032515 A1 Feb. 11, 2010

(51) Int. Cl.
*F42B 15/01* (2006.01)

(52) U.S. Cl. ..... 244/3.24; 244/3.1; 244/3.25

(58) Field of Classification Search ..... 102/473, 102/490, 385, 400; 244/45 A, 3.1, 3.24, 244/3.25; 86/51
See application file for complete search history.

(56) References Cited

U.S. PATENT DOCUMENTS

| | | | | | |
|---|---|---|---|---|---|
| 502,713 | A | * | 8/1893 | Gathmann | 244/3.24 |
| 2,842,058 | A | * | 7/1958 | Kuller et al. | 244/3.24 |
| 3,546,997 | A | | 12/1970 | Gould et al. | |
| 3,687,398 | A | * | 8/1972 | Beuschel | 244/3.24 |
| 4,351,503 | A | * | 9/1982 | Drori | 244/3.24 |
| 5,014,931 | A | * | 5/1991 | Mikhail | 244/3.25 |
| 5,062,585 | A | * | 11/1991 | Mikhail | 244/3.24 |
| 5,158,509 | A | * | 10/1992 | Ebaugh et al. | 244/3.24 |
| 5,203,395 | A | * | 4/1993 | Koller et al. | 160/263 |
| 6,227,096 | B1 | * | 5/2001 | Thomas | 89/1.54 |
| 6,981,672 | B2 | * | 1/2006 | Clancy et al. | 244/3.24 |
| 7,267,298 | B2 | * | 9/2007 | Leininger | 244/3.24 |
| 2005/0056723 | A1 | | 3/2005 | Clancy et al. | |
| 2008/0035786 | A1 | * | 2/2008 | Bilyk et al. | 244/13 |

FOREIGN PATENT DOCUMENTS

WO 2006080832 8/2006

OTHER PUBLICATIONS

International Search Report and Written Opinion from corresponding International Application No. PCT/US09/46357.

* cited by examiner

*Primary Examiner* — Tien Dinh
*Assistant Examiner* — Philip J Bonzell
(74) *Attorney, Agent, or Firm* — Renner, Otto, Boisselle & Sklar, LLP

(57) ABSTRACT

A fuze guidance system is configurable by an end user, allowing the end user to select between different configurations of canards of the system. The different configurations of canards may include canards with different surface areas, optimized for providing appropriate control with different sizes of munitions. The different configurations may be accomplished by having canards with separable portions which may be broken off or otherwise removed by the end user, to reduce canard surface area and/or span. Alternatively the fuze guidance system may come in a kit with multiple sets of canards having different sizes or otherwise having different configurations for providing different aerodynamic characteristics. The end user may select a canard set based on the munition size or type that the fuze guidance system is to be used with.

9 Claims, 5 Drawing Sheets

FUZE GUIDANCE SYSTEM WITH MULTIPLE CALIBER CAPABILITY

BACKGROUND OF THE INVENTION

1. Technical Field of the Invention

The field of the invention is fuze and guidance systems for projectiles.

2. Description of the Related Art

Smart fuzes have recently been used to provide better accuracy and effectiveness for munitions. It will be appreciated that improvements in systems utilizing smart fuzes would be desirable.

SUMMARY OF THE INVENTION

A fuze guidance system is configurable by an end user, allowing the end user to select between different configurations of canards of the system. The different configurations of canards may include canards with different surface areas, optimized for providing appropriate control with different sizes of munitions. The different configurations may be accomplished by having canards with separable portions which may be broken off or otherwise removed by the end user, to reduce canard surface area and/or span. Alternatively the fuze guidance system may come in a kit with multiple sets of canards having different sizes or otherwise having different configurations for providing different aerodynamic characteristics. The end user may select a canard set based on the munition size or type that the fuze guidance system is to be used with. The end user may then mechanically couple the selected canards to a main body of the fuze guidance system, to produce the desired configuration.

According to an aspect of the invention, a fuze guidance system is configurable by an end user for use with different sizes or types of munitions.

According to another aspect of the invention, a method of configuring a fuze guidance system includes an end user selectively configuring canards for the system.

According to still another aspect of the invention, a fuze guidance system has canards with portions that can be broken off or otherwise separated, allowing an end user to configure the canards by selecting their surface area, span, and/or other characteristics.

According to still another aspect of the invention, a fuze guidance system comes in the form of a kit having multiple sets of canards, with canards from one set having different aerodynamic characteristics then canards of another set. For example the canards of one set may have a different surface area, span, or other characteristics, relative to canards of another set. An end user may select a canard set to achieve desired aerodynamic characteristics, for example selecting a larger set of canards for use with a larger munition. The end user may mechanically attach or couple the canards to a fuze guidance system body.

According to a further aspect of the invention, a method of configuring a fuze system includes the steps of: selecting, by an end user, a size of gun-fired munition that the fuze system is to be used with; and configuring canards of the fuze system, by the end user, as a function of the size of the gun-fired munition that the fuze system is to be used with.

According to a still further aspect of the invention, a fuze system for use with a gun-fired munition includes: a fuze system body; and a kit having multiple sets of differently-configured canards. The fuze system body is configured for receiving a selected set of the canards, thereby allowing an end user to configure the fuze system for use with different sizes of munitions.

According to another aspect of the invention, a fuze system for use with a gun-fired munition includes: a fuze system body; and a pair of canards attached to fuze system body. The canards have embrittled lines that allow an end user to preferentially break the canards so as to resize the canards to allow the fuze system to be used with multiple sizes of munitions.

To the accomplishment of the foregoing and related ends, the invention comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

BRIEF DESCRIPTION OF THE DRAWINGS

In the annexed drawings, which are not necessarily to scale.

DETAILED DESCRIPTION

A fuze system has the capability of being configured by an end user for use with different sizes of munitions. In one embodiment, the fuze system includes a kit with multiple sets of canards, with each set having canards with different characteristics from those of canards of the other sets. For example, one set of canards may be longer than another set of canards, so as to provide larger forces for rotating a larger munition. An end user selects the proper set of canards as a function of the size of the munition that the fuze system is to be coupled to.

In another embodiment, canards attached to a main have portions that can be broken off by an end user, to change flight characteristics of the canards. The separable portions may be broken off or not broken off as a function of the size of munition that the fuze system is to be used with. For example, a smaller munition may require less force than a large munition in order to rotate the munition at an appropriate rate. For use with such a smaller munition, distal tips of the canards may be broken off, reducing the rotation forces from the canards.

Figure 1:
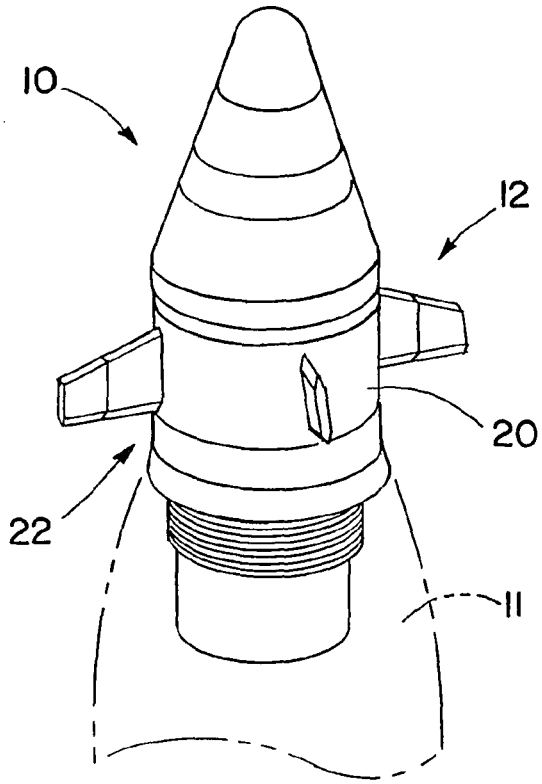
FIG. 1 is an orthogonal view of part of a first munition, having a fuze guidance system in a first configuration, in accordance with an aspect of the invention.
Figure 2:
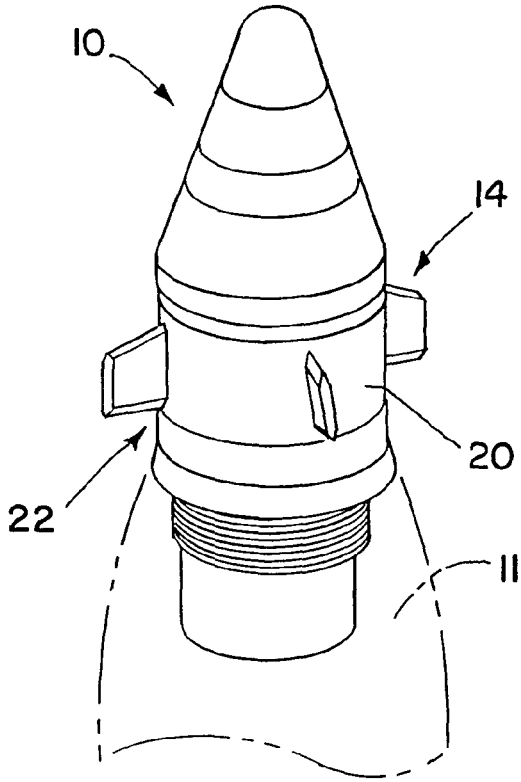
FIG. 2 is an oblique view of part of a second munition, with a fuze guidance system in a second configuration, in accordance with another aspect of an embodiment of the invention.

FIGS. 1 and 2 illustrate two configurations for a fuze guidance system 10. The fuze guidance system 10 is able to be configured by an end user for use with multiple calibers or sizes of gun-launched projectiles or other munitions 11. FIG. 1 shows a configuration for use with larger weapons, and FIG. 2 shows a configuration for use with smaller weapons. The difference between the two configurations is in the sizes of canards that are employed. FIG. 1 uses relatively large canards 12. The configuration in FIG. 2 uses relatively small canards 14. The canards 12 and 14 are used for guidance of the projectile or munition which the fuze guidance system 10 is coupled to. The fuze guidance system 10 includes a smart fuze that provides an ability to correct the course of the projectile or other munition. The canards 12 and 14 are used to divert the course of the projectile or munition, using well-understood aerodynamic forces. The smart fuze in the fuze guidance system 10 provides a means for detecting location and velocity of the projectile or munition. This information is provided to a control system of the fuze guidance system 10, which in turn selectively controls the roll position of the canards 12 or 14 to achieve desired maneuvers of the projectile.

Larger projectiles or munitions require larger moments to effect the same maneuvers. Therefore, in order for the same control system to be used with different types of munitions, it is desirable that the canards have different configurations suited to the different types of munitions. The configuration in FIG. 1, with its larger canards 12, is better suited for use with larger sized or larger caliber munitions, than is the configuration in FIG. 2 with its smaller canards 14. By effectively sizing the canards 12 and 14, it is possible to utilize a single fuze guidance system 10 with multiple sizes or calibers of projectile or munition.

The canards 12 and 14 are mechanically coupled to a collar ring 20, which is part of a guidance system main body 22. The canards 12 and 14 may be delivered to the end user already coupled to the collar ring 20. Alternatively the end user may couple the canards 12 and 14 to the collar ring 20.

It will be appreciated that it is advantageous to allow an end user to be able to configure the fuze guidance system 10 for use with different types of projectiles or other munitions. By having the fuze guidance system 10 configurable by an end user, it is possible to produce a single design of guidance system 10 that is usable with multiple types of projectiles. This results in flexibility, reducing the need to stock different types of fuze guidance systems, thus reducing inventory and costs.

Figure 3:
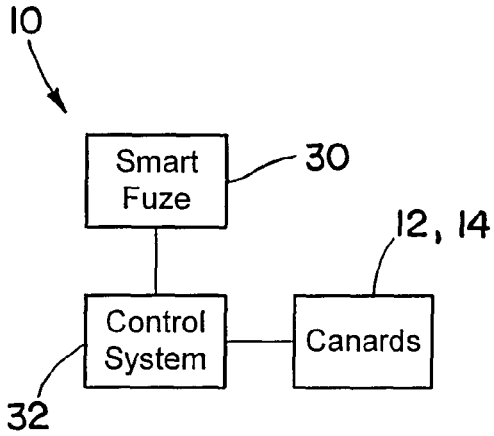
FIG. 3 is a block diagram showing some functionality of the fuze guidance systems of FIGS. 1 and 2.

FIG. 3 shows a block diagram providing a high-level view of operative components of the fuze guidance system 10. A smart fuze 30 provides information to a control system 32. The control system 32 controls the roll positioning of the canards 12 and 14 to accomplish desired course correction for the projectile. It will appreciated that known hardware and software may be used to accomplish these functions.

Figure 4:
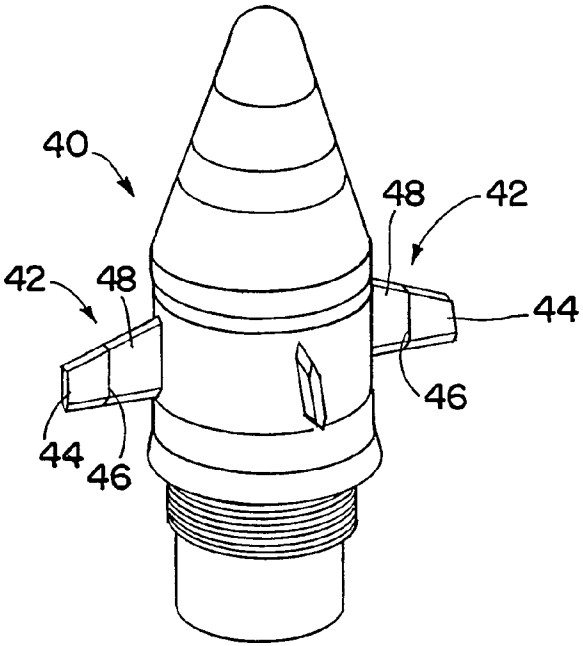
FIG. 4 is an oblique view of one embodiment of a fuze guidance system in accordance with an aspect of the present invention, a fuze guidance system having canards with separable portions.

FIG. 4 shows one embodiment that is capable of accomplishing the desired configurable guidance system. A fuze guidance system 40 has canards 42 that can be configured by an end user. The canards 42 have distal parts or portions 44 that can be selectively removed. The canards 42 can be broken along embrittled or weakened lines 46, to selectively remove the distal parts or portions 44. The weakened or embrittled break lines 46 may be mechanically and/or chemically weakened. An example of mechanical weakening is scoring along the break lines 46. Examples of chemical weakening or embrittlement include hydrogen embrittlement, oxygenation along the break lines 46, selective hard anodizing, and use of an alloy susceptible to stress corrosion cracking. It will be appreciated that the types of methods may be combined, for example by creating a small score line during manufacturing of the canards 42, followed by hard anodizing (type III anodizing) of the entire canards 42. The canards 42 may be made of a suitable material, such as aluminum, and the formation of the break lines 46 allows for repeatable breaking at a desired location by an end user.

Two configurations are possible for the canards 42. One is that shown in FIG. 4, a large or long canard configuration in which the removable portions 44 are left on as parts of the canards 42. This configuration may be suitable for use with larger projectiles, such as 155 mm rounds.

Figure 6:
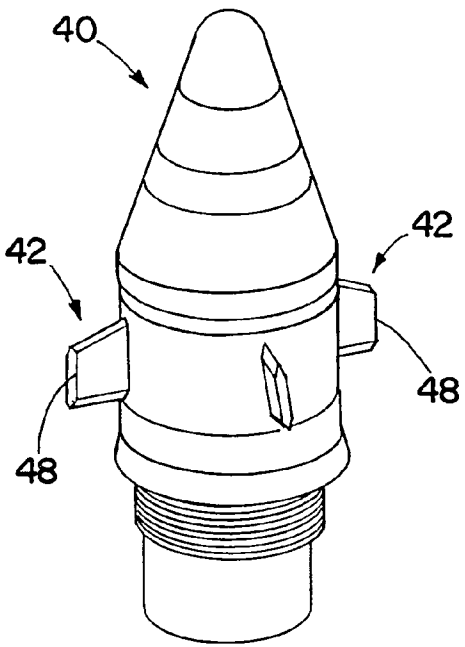
FIG. 6 is an oblique view of an alternate configuration of the fuze guidance system of FIG. 4, with portions of the canards removed.
Figure 5:
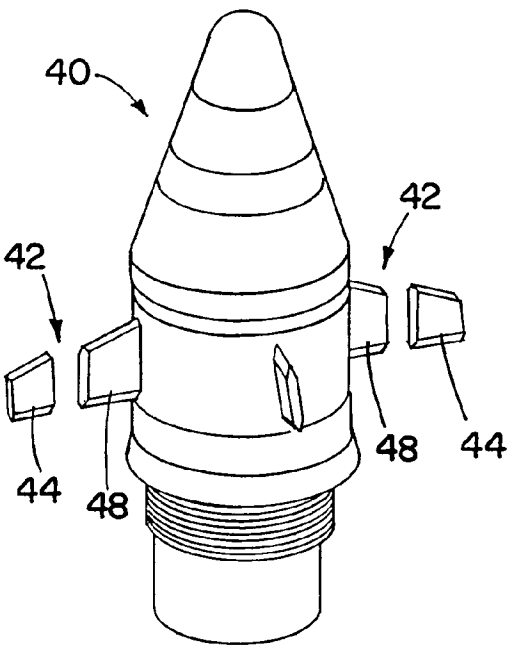
FIG. 5 is an oblique view illustrating the process of removing portions of the canards of the fuze guidance system of FIG. 4.

FIGS. 5 and 6 illustrate the other possible configuration for the canards 42. FIG. 5 shows removal of the distal parts or portions 44 by fracture or breaking along the break lines 46. This breaking may be performed by the end user, either by hand, or by use of suitable tools. A tool may be a specialized tool with appropriate push points or may be a simple vise grip. After breaking or removal, the distal portions 44 may be discarded. This leaves the canards 42 in a small configuration, as shown in FIG. 6. This configuration of the canards 42, with only the proximal canard portions or parts 48 remaining, has a reduced length and a reduced area, relative to the original configuration shown in FIG. 4. The reduced-area and reduced-length configuration may be suitable for smaller munitions, such as for use with a 105 mm round.

Figure 7:
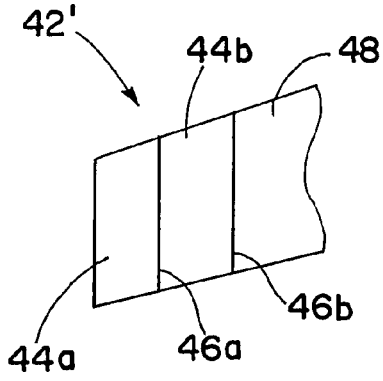
FIG. 7 is a plan view of another embodiment canard in accordance with another aspect of the present invention, a canard having multiple break lines.

FIG. 7 shows an alternative configuration, a canard 42' that has a pair of break lines 46*a* and 46*b*. The canard 42' has three possible configurations. For maximum size of the canard 42' the entire canard 42' is left intact. Breaking the canard 42' along a break line 46*a* removes a distal portion 44*a*. This provides an intermediate size to the canard 42'. Breaking the canard along a second break line 46*b* removes a pair of portions 44*a* and 44*b*, leaving only a proximal stub or portion 48. This configuration provides the minimum size and surface area for the canard 42'.

It will be appreciated that different combinations and configurations of break lines may be provided to allow an end user to configure a canard in a variety of ways. Although the configurations shown and described herein have involved break lines parallel to an axis of the fuze guidance system, it will be appreciated that break lines may be otherwise configured. Thus configuring the canard may involve operations other than reducing the span of the canards. For example a break line or lines may be configured to reduce the chord of the canards. It will be appreciated that other configurations and combinations of configurations are possible.

Figure 8:
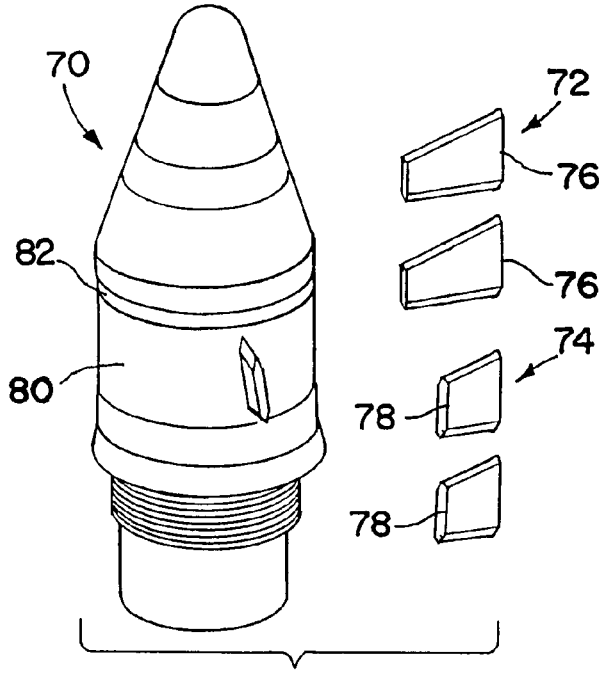
FIG. 8 is an oblique view of another embodiment fuze guidance system in accordance with the present invention, a system that includes a kit having multiple sets of canards.

FIG. 8 shows an alternative embodiment, a fuze guidance system 70 it comes in a kit form. The kit includes multiple canard sets 72 and 74. The canard set 72 has canards 76 in a different configuration from that of canards 78 of the canard set 74. For example, the canards 76 may have a larger area and/or a longer span than the canards 78. The canards 76 and 78 are configured to engage slots 80 in a fuze guidance system main body 82. The fuze guidance system 70 is configured by having the end user select one of the canard sets 72 or 74. The canards 76 or 78 of the selected set are then inserted into the slots 80 in the fuze guidance system main body 82. The canard sets 72 and 74 each have enough of the respective canards 76 and 78 to fully populate all of the slots 80 in the main body 82. The canard set 72 or the canard set 74 may be selected by the end user based on the intended projectile or munition that the fuze guidance system 70 is to be used with. For example, as with other embodiments described herein, larger canards (the canard set 72) may be used with a larger size munition, and smaller canards (the canard set 74) may be used with a smaller size munition.

Figure 9:
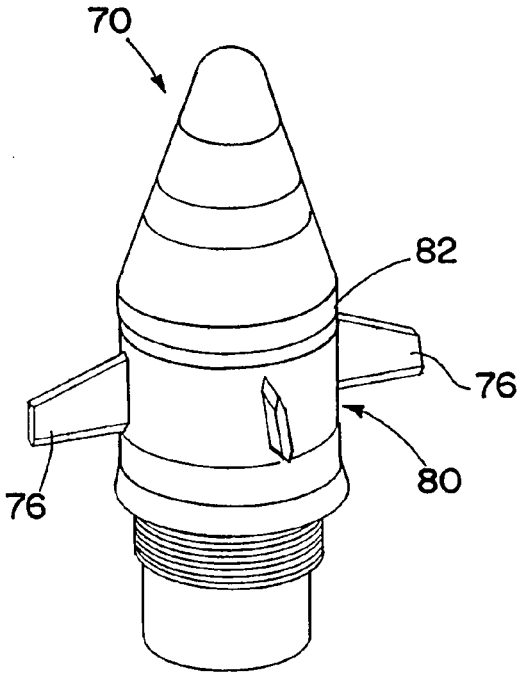
FIG. 9 is an oblique view showing the fuze guidance system of FIG. 8 in a first configuration.
Figure 10:
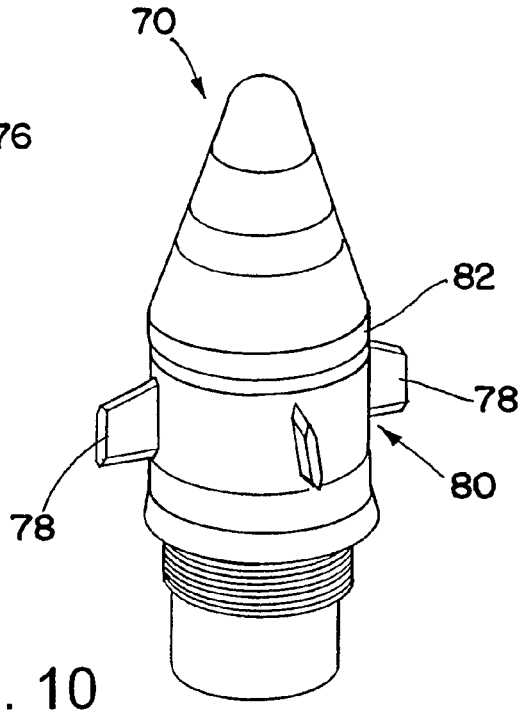
FIG. 10 is an oblique view showing the fuze guidance system of FIG. 8 in a second configuration.

FIG. 9 shows the end configuration of the fuze guidance system 70 with the larger canards 76 of the canard set 72 installed. FIG. 10 shows the configuration of the fuze guidance system 70 with the smaller canards 78 of the canard set 74 installed.

It will be appreciated that the fuze guidance system 70 may come with more than two sets of canards with different types of canards. The different types of canards may include different configurations of canards suitable for use with different sizes or other types of munitions. The different types of canards may have different areas, different chords, different spans, or other suitably different configurations.

The unused canard set 72 or 74 may be discarded by the end user. Alternatively the unused canard set may be saved for possible use with another fuze guidance system.

The slots 80 may have any of a variety of suitable mechanical configurations for receiving and securing the canards 76 or 78. To give one example, the slots 80 may have detents or other suitable securing mechanisms for receiving and securing the canard 76 or 78.

Figure 13:
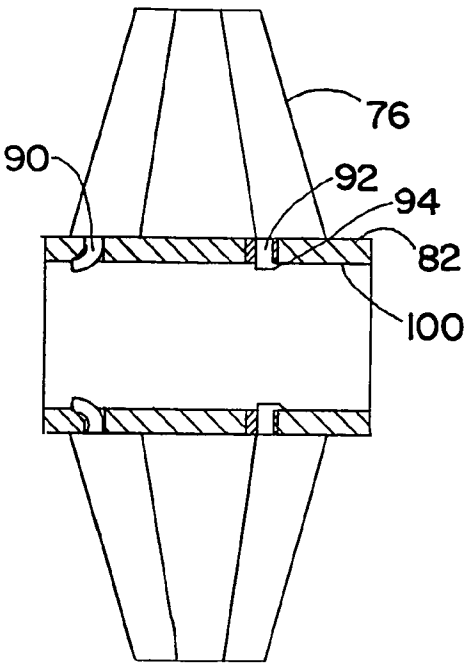
FIG. 13 shows a second step in the coupling.
Figure 12:
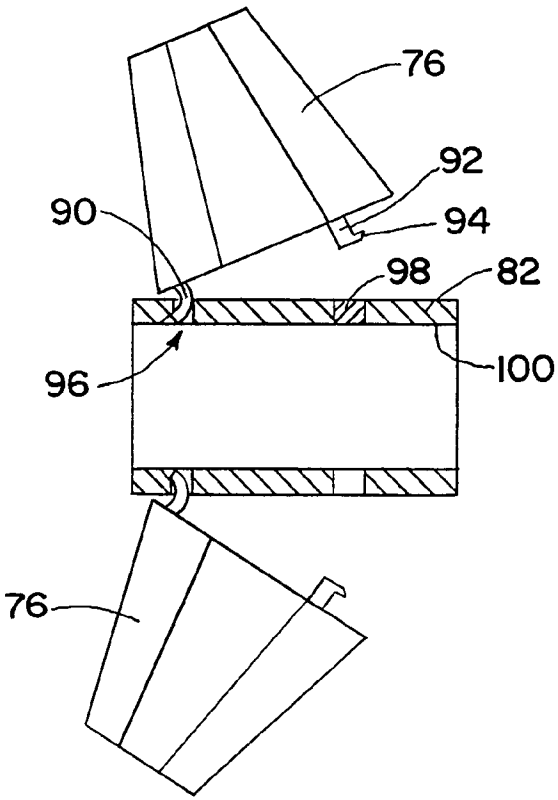
FIG. 12 shows a first step in the coupling process of coupling together the canards and fuze guidance system main body of FIG. 11.
Figure 11:
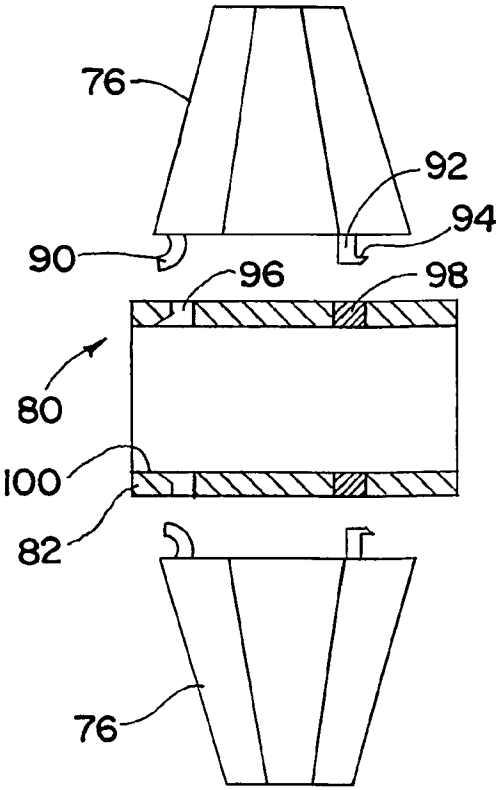
FIG. 11 is a cross-sectional view showing one possible configuration for mechanically coupling the canards of the system of FIG. 8 to the fuze guidance system main body.

FIGS. 11-13 show another possible mechanical connection configuration. The configuration is shown with regard to securing of the canard 76. It will be appreciated that a similar mechanism may be provided on the canard 78 (FIG. 8). The canards 76 each have a curved hook 90 and an L-shape member 92. The L-shape member 92 has a tab 94. The canards 76 may be tilted to allow the hooks 90 to be inserted into first holes 96, as shown in FIG. 12. The canards 76 are then rotated into place, pivoting around the hook 90. The L-shape members 92 engage second holes 98 of the slots 80. The tabs 94 resiliently deform as the L-shape members 92 are inserted into the second holes 98. When the canards 76 are fully engaged with the slots 80 the tabs 94 have passed fully through the second holes 98. The tabs 94 spring back and engage an inner wall 100 of the main body 82.

Figure 15:
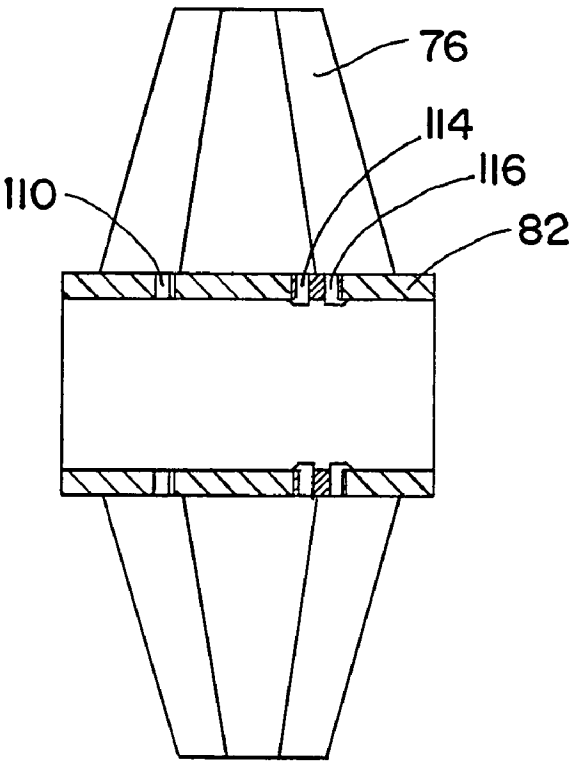
FIG. 15 shows the configuration of FIG. 14, installed on the Fuze guidance main body.
Figure 14:
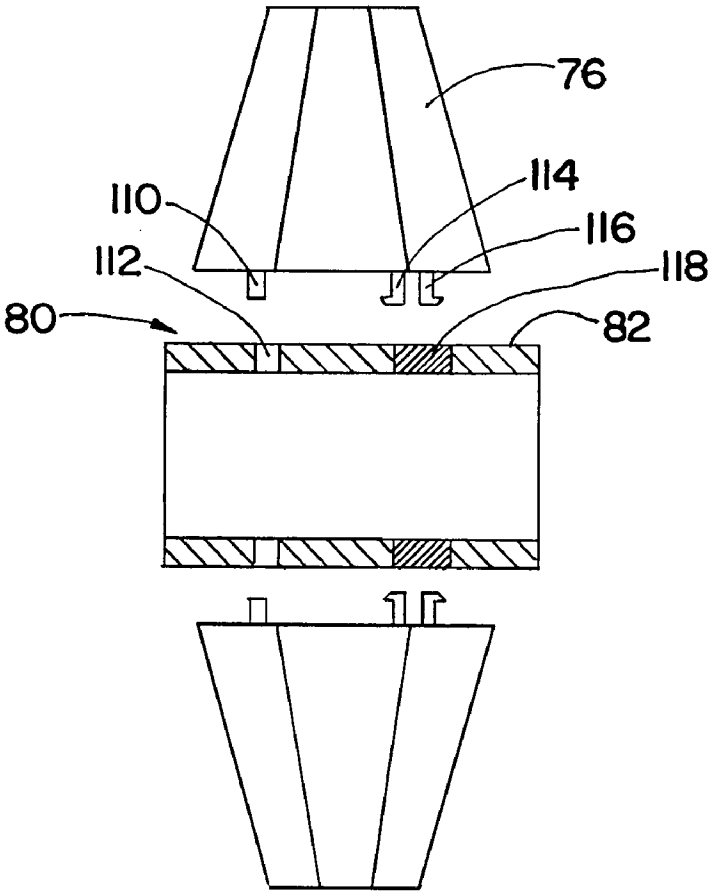
FIG. 14 is a cross-sectional view showing another possible configuration for mechanically coupling the canards of the system of FIG. 8 to the fuze guidance system main body.

FIGS. 14 and 15 shows still another possible mechanical connection configuration. In the configuration shown in FIGS. 14 and 15 the canard 76 includes a tab 110 that fits into a first hole 112 in the main body 82. The canard 76 also includes a pair of L-shape members 114 and 116 that engage a second hole 118. It will be appreciated that the holes 112 and 118 together constitute a slot 80, and that the L-shape members 114 and 116 may engage the second hole 118 in a manner similar to that described above with regard to FIGS. 11-13.

Providing the end user with the ability to appropriately configure a fuze guidance system provides flexibility in use. The appropriate control authority may be provided without the need to stock two separate sizes or types of fuze guidance systems. Reduction in inventory and associated costs is another advantage of the present system.

Although the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A method of configuring a fuze system, the method comprising:

selecting, by an end user, a size of gun-fired munition that the fuze system is to be used with, from multiple possible sizes of gun-fired munitions; and configuring canards of the fuze system, by the end user, as a function of the size of the gun-fired munition that the fuze system is to be used with, wherein the fuze system is configurable for use with the multiple possible sizes of gun-fired munitions;

wherein the configuring includes choosing whether to break off parts of the canards along predetermined break lines, and if necessary, breaking off the parts of the canards before flight.

2. The method of claim 1, wherein the breaking off includes breaking off distal tips of the canards, thereby shortening the canards.

3. The method of claim 1, wherein the configuring the canards includes selecting a length of the canards as a function of the size of the gun-fired munition that the fuze system is to be used with.

4. The method of claim 1, wherein the breaking off includes breaking off the parts along embrittled lines on the canards.

5. The method of claim 4, wherein the embrittled lines are scored lines.

6. The method of claim 4, wherein the embrittled lines are lines weakened by chemical etching.

7. A fuze system for use with a gun-fired munition, the system comprising:

a fuze system body; and a pair of canards attached to fuze system body;

wherein the canards have embrittled lines that allow an end user to preferentially break the canards before flight so as to resize the canards to allow the fuze system to be used with multiple sizes of munitions.

8. The fuze system of claim 7, wherein the embrittled lines are scored lines.

9. The fuze system of claim 7, wherein the embrittled lines are lines weakened by chemical etching.

* * * * *